US005420095A

United States Patent [19]

Bodem et al.

[11] Patent Number: 5,420,095

[45] Date of Patent: May 30, 1995

[54] SUBBING LAYER FOR RECEIVER USED IN THERMAL DYE TRANSFER

[75] Inventors: George B. Bodem, Pittsford; Linda Kaszczuk, Webster; Wayne A. Bowman, Walworth, all of N.Y.

[73] Assignee: Eastman Kodak Company, Rochester, N.Y.

[21] Appl. No.: 321,273

[22] Filed: Oct. 11, 1994

[51] Int. Cl.[6] ..... B41M 5/035; B41M 5/38

[52] U.S. Cl. ..... 503/227; 428/195; 428/341; 428/412; 428/500; 428/515; 428/913; 428/914

[58] Field of Search ..... 8/471; 428/195, 341, 428/412, 500, 515, 913, 914; 503/227

[56] References Cited

U.S. PATENT DOCUMENTS 5,055,444 10/1991 Kaszczuk ..... 503/227
5,147,846 9/1992 Harrison et al. ..... 503/227

*Primary Examiner*—B. Hamilton Hess
*Attorney, Agent, or Firm*—Harold E. Cole

[57] ABSTRACT

A dye-receiving element for thermal dye transfer comprising a support having on one side thereof, in order, a cushion layer of an acrylic polymer, a subbing layer, and a polymeric dye image-receiving layer, wherein said subbing layer is a poly(vinyl acetal) and is present at a coverage of at least 0.17 g/m$^2$.

20 Claims, No Drawings

SUBBING LAYER FOR RECEIVER USED IN THERMAL DYE TRANSFER

This invention relates to dye-receiving elements used in thermal dye transfer, and more particularly to a particular subbing layer for such elements.

In recent years, thermal transfer systems have been developed to obtain prints from pictures which have been generated electronically from a color video camera, According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements for thermal dye transfer generally comprise a polymeric dye image-receiving layer coated on a support. A compression, or cushion intermediate layer, for example as taught in U.S. Pat. No. 4,734,397 may also be present between the support and the dye image-receiving layer. Such cushion layers promote better contact between a dye-donor element and the dye-receiving element, which minimizes the formation of image defects during dye transfer and improves the scratch resistance of the dye-receiving element. In addition, subbing layers, for example as taught by U.S. Pat. No. 4,748,150, may also be present between the various layers to promote adhesion.

U.S. Pat. No. 5,055,444 discloses an intermediate receiving element for thermal dye transfer wherein a subbing layer of crosslinked poly(vinyl acetal-co-vinyl alcohol) is used between a dye image-receiving layer and a separable polyolefin layer. The dye image-receiving layer is separated from the intermediate receiver for transfer to a final receiving element. There is no disclosure in this patent that a cushion layer of an acrylic polymer should be used instead of a separable polyolefin layer.

U.S. Pat. No. 5,147,846 discloses the use of a subbing layer between a cushion layer and a dye image-receiving layer of a dye-receiving element. The particular subbing layers disclosed include copolymers of vinylidene chloride, e.g., poly(acrylonitrile-co-vinylidene chloride-co-acrylic acid). While these subbing layers have proved effective, a problem has developed in the stability to light, or dye fade, for the dyes, especially the cyan dye, which are transferred to the dye-receiving element. Such dye fade will invariably result in undesirable image deterioration.

It is an object of this invention to provide a dye-receiving element having a subbing layer between a cushion layer and a dye image-receiving layer which will provide improved stability to light for the transferred dyes, while maintaining adequate adhesion.

These and other objects are achieved in accordance with this invention which comprises a dye-receiving element for thermal dye transfer comprising a support having on one side thereof, in order, a cushion layer of an acrylic polymer, a subbing layer, and a polymeric dye image-receiving layer, wherein the subbing layer is a poly(vinyl acetal) and is present at a coverage of at least 0.17 g/m$^2$.

In a preferred embodiment of the invention, the poly(vinyl acetal) has the following formula:

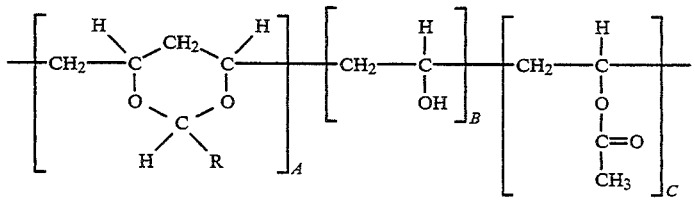

wherein R is hydrogen, $-(CH_2)_x-CH_3$, or

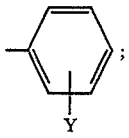

x is 0–6;

Y is hydrogen, halogen, alkyl or alkoxy of 1–6 carbon atoms, aryl of 6 to 10 carbon atoms, or a carboxylate ester;

A ranges from 30–95 mole %;

B ranges from 5–65 mole %; and

C ranges from 0–25 mole %.

In another preferred embodiment, R in the above formula is $CH_3$. In still another preferred embodiment of the invention, A is at least 60 mole %.

Poly(vinyl acetals) within the above formula include poly(vinyl formal), poly(vinyl acetal), poly(vinyl propional), poly(vinyl butyral), poly(vinyl benzal) and substituted poly(vinyl benzal).

As described above, a cushion layer is employed in the receiving element which is an acrylic polymer. These polymers are more fully described in U.S. Pat. No. 4,734,397, the disclosure of which is hereby incorporated by reference. These polymers include poly(methyl methacrylate), poly(styrene-co-acrylonitrile), poly(n-butyl acrylate-co-acrylic acid), etc. In a preferred embodiment of the invention, the cushion layer is a copolymer of butyl acrylate and acrylic acid.

The compliant or cushion layer and subbing layer may be coated simultaneously, if desired.

The support for the dye-receiving element of the invention includes films of poly(ether sulfone(s)), polyimides, poly(vinyl chloride), cellulose esters such as cellulose acetate, poly(ethylene terephthalate), and poly(ethylene naphthalate). In a preferred embodiment, the support is transparent. The support may be employed at any desired thickness, usually from about 10 μm to 1000 μm.

The dye image-receiving layer of the dye-receiving elements of the invention may comprise, for example, a polycarbonate, a polyurethane, a polyester, poly(vinyl chloride), poly(styrene-co-acrylonitrile), polycaprolactone or mixtures thereof. In a preferred embodiment, polycarbonates are employed. The dye image-receiving layer may be present in any amount which is effective for the intended purpose. In general, good results have been obtained at from about 1 to about 10 g/m$^2$. An overcoat layer may be further coated over the dye-receiving layer such as those described in U.S. Pat. No. 4,775,657, the disclosure of which is incorporated by reference.

Conventional dye-donor elements may be used with the dye-receiving element of the invention. Such donor elements generally comprise a support having thereon a dye-containing layer. Any dye can be used in the dye-donor employed in the invention provided it is transferable to the dye-receiving layer by the action of heat. Especially good results have been obtained with diffusible dyes. Dye donors applicable for use in the present invention are described, e.g., in U.S. Pat. Nos. 4,916,112, 4,927,803 and 5,023,228, the disclosures of which are incorporated by reference.

The dye-donor element employed in certain embodiments of the invention may be used in sheet form or in a continuous roll or ribbon. If a continuous roll or ribbon is employed, it may have only one dye thereon, mixtures of dyes or may have alternating areas of different dyes such as cyan, magenta, yellow, black, etc., as disclosed in U.S. Pat. No. 4,541,830.

A process of forming a dye transfer image according to the invention comprises:

a) imagewise-heating a dye-donor element comprising a support having thereon a dye layer comprising a dye dispersed in a binder, and b) transferring a dye image to a dye-receiving element as described above to form said dye transfer image.

In a preferred embodiment of the invention, a dye-donor element is employed which comprises a poly(ethylene terephthalate) support coated with sequential repeating areas of cyan, magenta and yellow dye, and the dye transfer process steps are sequentially performed for each color to obtain a three-color dye transfer image.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer, such as laser or ultrasound, may be used.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought into register with the dye-receiving element and the process repeated. The third color is obtained in the same manner.

The following examples are provided to further illustrate the invention.

EXAMPLE 1

A) A dye-receiver element in accordance with the invention was prepared by coating on a transparent 118 μm (4.7 mil) poly(ethylene terephthalate) (PET) the following layers:

1) a subbing layer of poly(acrylonitrile-co-vinylidene chloride-co-acrylic acid) (14:79:7 wt ratio)(AVcAa) (0.05 g/m$^2$);

a cushion layer of a mixture of poly(n-butyl acrylate-co-acrylic acid) (50:50 wt. ratio) (8.1 g/m$^2$), 1,4-butanediol diglycidyl ether (0.57 g/m$^2$), tributylamine (0.32 g/m$^2$), and Fluorad FC-431® perfluoroamido surfactant (3M Corp.) (0.016 g/m$^2$) from acetone/water solvent;

3) a subbing layer of KS-3 (a poly(vinyl acetal-co-vinyl alcohol), viscosity 110–170 cps, 25 mole % hydroxyl, 1 mole % acetyl, 74 mole % acetal in a 3-pentanone-methanol 75:25 solvent mixture, (Sekisui Chemical Co.) (0.54 g/m$^2$) coated from a solution of 2-butanone/methanol (85:15) containing Fluorad FC-431®;

a dye image-receiving layer of Makrolon® KL3-1013 polycarbonate (Bayer AG), (1.78 g/m$^2$), Lexan® 141–112 polycarbonate (General Electric Co.) (1.45 g/m$^2$), dibutyl phthalate), (0.32 g/m$^2$), diphenyl phthalate (0.32 g/m$^2$), and Fluorad FC-431® (0.011 g/m$^2$) dissolved in methylene chloride; and b 5) an overcoat layer comprising a mixture of a polycarbonate random terpolymer (50 mole % bisphenol A, 49 mole % diethylene glycol, and 1 mole % 2,500 MW polydimethylsiloxane block units) (0.22 g/m$^2$) with Fluorad FC-431® and Dow-Corning 510 Silicone Fluid (a mixture of dimethyl and methyl phenyl siloxanes) (0.005 g/m$^2$) dissolved in methylene chloride.

B) Another element according to the invention was prepared similar to A) except that the subbing layer was KS-5 (a poly(vinyl acetal-co-vinyl alcohol) of the same composition as KS-3 but with a viscosity of 200–300 cps.) (0.54 g/m$^2$) coated from the same solvent mixture.

C) A control element was prepared similar to A) except that the subbing layer was AVcAa (0.54 g/m$^2$) coated from the same solvent mixture containing Fluorad FC-431®.

A protective layer element was prepared by coating on one side of a 6 μm PET support a protective layer comprising Sekisui KS-1 (a poly(vinyl acetal-co-vinyl alcohol) of the same composition as KS-3 but with a viscosity of 50–100 cps.) (Sekisui Chemical Co.), (0.45 g/m$^2$), and divinylbenzene beads, 4.0 μm, (0.086 g/m$^2$) from 3-pentanone.

On the other side of the protective layer element was coated a subbing layer of Tyzor TBT® titanium tetran-butoxide, (DuPont Corp.) (0.12 g/m$^2$) from a n-propyl acetate and 1-butanol solvent mixture, and a slipping layer of cellulose acetate propionate (2.5% acetyl, 45% propionyl) (0.532 g/m$^2$), PS 513 (an aminopropyl dimethyl-terminated polydimethylsiloxane) (Huels America Inc.) (0.11 g/m$^2$), p-toluenesulfonic acid (5% methanol) (0.003 g/m$^2$) and Candelilla wax particles (Strahl and Pitsch) (0.021 g/m$^2$) coated from a toluene, methanol, and cyclopentanone solvent mixture.

A dye-donor element of sequential areas of yellow, magenta, and cyan dye was prepared by coating the following layers, in order, on a 6 μm PET support:

1) a Tyzor TBT® subbing layer as shown above for the protective layer element; and
2) a dye layer containing sequential, repeating areas of yellow, magenta and cyan dyes as follows:
   a) a yellow area comprising a mixture of yellow dye A (0.266 g/m$^2$), cellulose acetate propionate (0.360 g/m$^2$), S363N-1 polypropylene wax beads (Shamrock Technologies, Inc.) (0.011 g/m$^2$) and Fluorad FC-430® (0.002 g/m$^2$) coated from a mixture of toluene, methanol and cyclopentanone;
   b) a magenta area comprising a mixture of magenta dye B (0.174 g/m$^2$), magenta dye C (0.160 g/m$^2$), cellulose acetate propionate (0.292 g/m$^2$), 2,3-dihydro-1,1,3,-trimethyl-N-(2,4,6-trimethylphenyl-3-[4[[2,4,6-trimethyl-phenyl) amino]carbonyl]-phenyl]-1H-indene-5-carboxamide (0.051 g/m$^2$), S363N-1 polypropylene wax beads (0.012 g/m$^2$) and Fluorad FC-430® (0.002 g/m$^2$) coated from a mixture of toluene, methanol and cyclopentanone;
   c) a cyan area comprising a mixture of cyan dye D (0.409 g/m$^2$), cyan dye E (0.117 g/m$^2$), cellulose acetate propionate (0.296 g/m$^2$), 2,3-dihydro-1,1,3-trimethyl-N-(2,4,6-trimethylphenyl)-3-[4[[2,4,6-trimethyl-phenyl)amino]-carbonyl]-phenyl]-1H-indene-5-carboxamide (0.068 g/m$^2$), S363N-1 polypropylene wax beads (0.022 g/m$^2$) and Fluorad FC-430® (0.002 g/m$^2$) coated from a mixture of toluene, methanol and cyclopentanone.

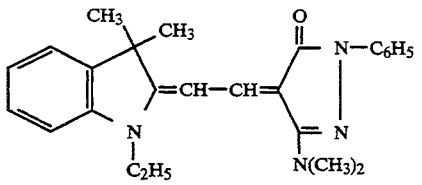

Yellow Dye A

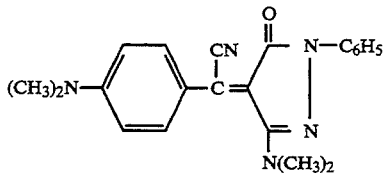

Magenta Dye B

-continued

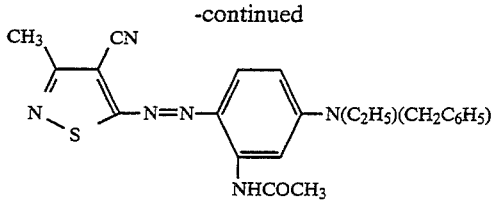

Magenta Dye C

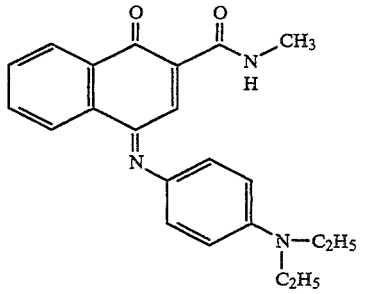

Cyan Dye D

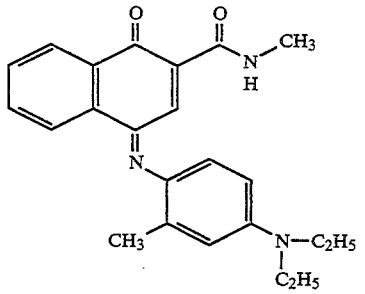

Cyan Dye E

On the other side of the dye-donor element were coated the same subbing layer as was used on the dye side and a slipping layer which was the same as the one used on the protective layer element above.

Tests were run with the above dye-receiver and dye-donor elements by placing the dye side of a dye-donor element, approximately 10 cm by 13 cm in area, in contact with the polymeric dye image-receiving layer side of a dye-receiving element of the same area. The assemblage was fastened to the top of a motor-driven 56 mm diameter rubber roller and a TDK Thermal Head L-231 was pressed with a force of approximately 23 Newton against the dye-donor element side of the assemblage pushing the dye-donor against the rubber roller.

The imaging electronics were activated and the assemblage was drawn between the printing head and the roller at 26.2 mm/sec. Coincidentally, the resistive elements in the head were pulsed in a specified pattern for 29 μs/pulse at 128 μs intervals during the 8.2 μs/dot line printing time to create an image.

When the image had been formed, the protective layer element was placed in contact with the printed image and heated uniformly at an energy level equivalent to a maximum print dye density (2.52 mJoule/dot) with the thermal print head to permanently adhere the polymeric film to the print. At the end of the heating cycle, the dye-donor support was peeled away leaving the polymeric film adhering to the print.

Neutral stepped images were obtained by printing sequentially from the three donor patches. The Status A red, green and blue transmission densities of the stepped images were obtained. The imaged dye-receivers, laminated with protective layers as described above, were then tested for their light stability by subjecting them to High-Intensity Daylight fading (HID fading) for 7 days, 50 kLux, 5400 deg. K., °C., approximately 25% RH, and the densities were reread. The percent density losses after fade at 0.5 density were calculated. The following results were obtained:

TABLE 1

| Subbing Layer | % LOSS AT 0.5 Density | | |
|---|---|---|---|
| | Red | Green | Blue |
| AVcAa (Control) | 24.3 | 3.5 | 5.3 |
| KS-3 (PVAc) | 5.3 | 0.0 | −0.1 |
| KS-5 (PVAc) | 2.9 | −0.8 | −0.4 |

The above results show that the light stability of transferred dyes, especially the red, using the subbing layer polymers of the invention was superior to the prior art control subbing layer.

EXAMPLE 2

Another experiment was run to establish the range of poly(vinyl acetal) types in the subbing layer between the cushion and dye-receiving layers useful for achieving good adhesion properties.

Dye-receiver elements were prepared by coating on a transparent 175 μm PET the following layers:

1) a cushion layer of a mixture of poly(n-butyl acrylate-co-acrylic acid) (50:50 wt. ratio) (8.1 g/m$^2$), 1,4-butanediol diglycidyl ether (0.57 g/m$^2$), and tributylamine (0.32 g/m$^2$) from acetone/water solvent;
2) a subbing layer as shown in the Table 2 below at 0.54 g/m$^2$;
4) a dye image-receiving layer of Makrolon® 5700 polycarbonate (Bayer AG), (4.0 g/m$^2$); Fluorad FC-431® (0.005 g/m$^2$) (used in C1 and E1–E3 only); dibutyl phthalate (0.29 g/m$^2$); diphenyl phthalate (0.44 g/m$^2$); and 2,5-bis(decyloxy)-1,4-dimethyoxybenzene (0.005 g/m$^2$) (used in C–2 and E4–E7 only); and
5) overcoat layer (used in C2 and E4–E7 only) of polycaprolactone (0.08 g/m$^2$); Fluorad FC-431® (0.01 g/m$^2$); and DC 510 (Dow Corning surfactant) (0.01 g/m$^2$).

To evaluate the adhesive strength of the subbing layers, the peel strength of the dye-receiver elements with various subbing compositions was measured using a T-Peel adhesive test (ASTM D 1876) on an 1122 Instron tensile testing instrument. Samples were laminated with a 175 μm PET support coated with Bostik 7962® copolyester adhesive (Bostik Chemical Group, Emhart Corp.) at 121° C., cooled, and the receiver/-laminate package cut into 15 cm ×2 cm strips. The samples were T-peeled at a peeling rate of 10.1 cm/min. Five to six repeat tests were run with each sample to provide an average peel strength as shown below in Table 2. The following results were obtained:

TABLE 2

| SAMPLE | Subbing Layer | mole % acetal | mole % OH | mole % other | Peel strength (N/m) |
|---|---|---|---|---|---|
| C1 (Control) | AVcAa | | | | 14.2 |
| C2 (Control) | AVcAa | | | | 22.3 |
| E1 | PVAc | 92% | 6% | 2% acetate | 1067 |
| E2 | PVAc | 68% | 32% | — | 1637 |
| E3 | PVAc | 54.2% | 43.6% | 2.2% acetyl | 1385 |
| E4 | PVAc | 41% | 39% | 20% acetate | 1470 |
| E5 | PVAc | 34% | 64% | — | 1779 |
| E6 | Formvar 7/95 ®* | | | | 1979 |
| E7 | Formvar 15/95 ®* | | | | 1890 |

*a vinyl formal available from Monsanto Co.

The above results show that peel strength is independent of the mole % acetal. All of the above acetals according to the invention show superior peel strength as compared to the controls. Further, the superior peel performance of the acetals is independent of the acetate level in the polymer and the type of acetal (i.e. acetal, formal, etc).

EXAMPLE 3

To demonstrate the effect of molecular weight of the poly(vinyl acetal) used in the subbing layer, a dye-receiving element similar to Example 2 was prepared using both high and low molecular weight PVAc's. The elements were then tested according to the procedure of Example 2. The following results were obtained:

TABLE 3

| Sample | Subbing Layer | mole % acetal | mole % OH | MW | Peel strength (N/m) |
|---|---|---|---|---|---|
| E5 | PVAc | 34% | 64% | 200K | 1779 |
| E8 | PVAc | 34% | 64% | 20K | 1820 |

The above results show that the molecular weight of the PVAc in the subbing layer has little effect on peel strength.

EXAMPLE 4

A test series was run to provide a comparison of different laydowns (g/m$^2$) of PVAc's in their effectiveness to bond to the overlying dye-receiving layer.

A dye-receiver element in accordance with the invention was prepared by coating on a transparent 175 μm (7 mil) PET support the following layers:

1) a subbing layer of AVcAa (0.05 g/m$^2$);
2) a cushion layer of a mixture of poly(n-butyl acrylate-co-acrylic acid) (50:50 wt. ratio) (8.1 g/m$^2$), 1,4-butanediol diglycidyl ether (0.57 g/m$^2$), tributylamine (0.32 g/m$^2$), and Fluorad FC-431® (0.016 g/m$^2$) from acetone/water solvent;
3) a subbing layer in the amounts shown in Table 4 of poly(vinyl acetal-co-vinyl alcohol) of molecular weight 188,000 and 85 mole % acetal content from an 85:15 solution of 2 -butanone:methanol containing Fluorad FC-431® (0.016 g/m$^2$) and
4) a dye image-receiving layer of Makrolon 5700® (3.94 g/m$^2$), 1,4-didecoxy-2,5-dimethoxybenzene (0.52 g/m$^2$), and Fluorad FC-431® (0.016 g/m$^2$) from an 85:15 2-butanone:methanol solvent mixture.

In this Example, each dye-receiver element was then subjected to a tape adhesion test as generally described by W. T. Diefenbach in Tappi 45, 840 (1962). The receiver surface was first carefully scored in an "X" pattern. A small area (approximately 1.9 cm ×5.1 cm) of Scotch ® Magic Transparent Tape (available from 3M Corp.) was firmly pressed by hand over the scored area of the receiver surface, leaving enough area free to serve as a handle for pulling the tape. The latter was rapidly pulled off the receiver element at a 90° angle. In the ideal case, no material of the receiver layer would be removed, indicating a "passing" performance. On the other hand, removal of receiver layer material would indicate a weak bond, designated as "fail", between cushion and dye-receiving layers. The following results were obtained:

TABLE 4

| SAMPLE | g/m² | TAPE ADHESION |
|---|---|---|
| 1 | 0.11 | Fail |
| 2 | 0.22 | Pass |
| 3 | 0.35 | Pass |
| 4 | 0.54 | Pass |

The above data show that a laydown of greater than 0.11 g/m²) is required for adequate adhesion between the cushion layer and dye-receiving layer.

EXAMPLE 5

This experiment was run to demonstrate the range of acetals in the subbing layer for achieving good light stability for the transferred dyes to the dye-receiving element.

Samples were prepared as shown above for Example 2 and then subjected to the light fade test as in Example 1 above. The following results were obtained:

TABLE 5

| Subbing Layer | % LOSS AT 0.5 Density Red | Green | Blue |
|---|---|---|---|
| Formvar 5/95 ® (Monsanto Co.) | 10 | 6 | 2 |
| KS-1 ® (Sekisui Chemical Co.) | 10 | 6 | 4 |
| poly(vinyl propional) | 10 | 6 | 2 |
| Butvar-72 ® (Monsanto Co.) | 10 | 6 | 2 |
| Butvar-74 ® (Monsanto Co.) | 10 | 6 | 4 |
| Butvar-98 ® (Monsanto Co.) | 12 | 6 | 2 |
| poly(vinyl benzal) | 12 | 6 | 4 |
| poly(vinyl dichlorobenzal) | 10 | 6 | 4 |
| poly(vinyl p-phenylbenzal) | 10 | 6 | 4 |
| poly(vinyl carbomethoxylbenzal) | 10 | 6 | 2 |
| poly(vinyl p-methoxybenzal) | 10 | 6 | 4 |
| AVcAa (Control) | 34 | 10 | 6 |

The above results show that the light stability of the transferred dyes, especially the red density, using the subbing layer polymers of the invention was superior to the prior art control subbing layer.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof, in order, a cushion layer of an acrylic polymer, a subbing layer, and a polymeric dye image-receiving layer, wherein said subbing layer is a poly(vinyl acetal) and is present at a coverage of at least 0.17 g/m².

2. The dye-receiving element of claim 1 wherein said poly(vinyl acetal) has the following formula:

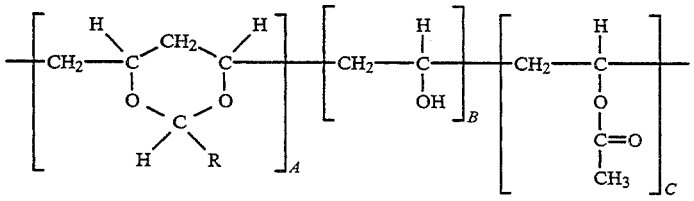

wherein R is hydrogen, $-(CH_2)_x-CH_3$, or

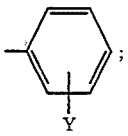

x is 0–6;

Y is hydrogen, halogen, alkyl or alkoxy of 1–6 carbon atoms, aryl of 6 to 10 carbon atoms, or a carboxylate ester;

A ranges from 30–95 mole %;

B ranges from 5–65 mole %; and

C ranges from 0–25 mole %.

3. The element of claim 2 wherein R is $CH_3$.

4. The element of claim 2 wherein A is at least 60 mole %.

5. The element of claim 1 wherein said support is transparent.

6. The element of claim 1 wherein said cushion layer is a copolymer of butyl acrylate and acrylic acid.

7. The element of claim 1 wherein said polymeric dye image-receiving layer comprises a polycarbonate.

8. A process of forming a dye transfer image comprising:

a) imagewise-heating a dye-donor element comprising a support having thereon a dye layer comprising a dye dispersed in a binder, and b) transferring a dye image to a dye-receiving element to form said dye transfer image, wherein said dye-receiving element comprises a support having on one side thereof, in order, a cushion layer of an acrylic polymer, a subbing layer, and a polymeric dye image-receiving layer, wherein said subbing layer is a poly(vinyl acetal) and is present at a coverage of at least 0.17 g/m².

9. The process of claim 8 wherein said poly(vinyl acetal) has the following formula:

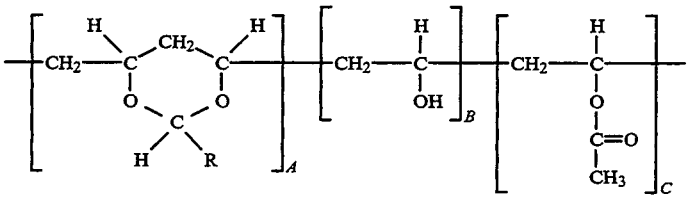

wherein R is hydrogen, $-(CH_2)_x-CH_3$, or

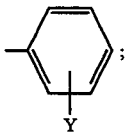

x is 0–6;

Y is hydrogen, halogen, alkyl or alkoxy of 1–6 carbon atoms, aryl of 6 to 10 carbon atoms, or a carboxylate ester;

A ranges from 30–95 mole %;

B ranges from 5–65 mole %; and

C ranges from 0–25 mole %.

10. The process of claim 9 wherein R is $CH_3$.

11. The process of claim 9 wherein A is at least 60 mole %.

12. The process of claim 8 wherein said support is transparent.

13. The process of claim 8 wherein said cushion layer is a copolymer of butyl acrylate and acrylic acid.

14. The process of claim 8 wherein said polymeric dye image-receiving layer comprises a polycarbonate.

15. A thermal dye transfer assemblage comprising:

a) a dye-donor element comprising a support having thereon a dye layer comprising a dye dispersed in a binder, and b) a dye-receiving element comprising a support having on one side thereof, in order, a cushion layer of an acrylic polymer, a subbing layer, and a polymeric dye image-receiving layer, wherein said subbing layer is a poly(vinyl acetal) and is present at a coverage of at least 0.17 g/m$^2$, said dye-receiving element being in a superposed relationship with said dye-donor element so that said dye layer is in contact with said dye image-receiving layer.

16. The assemblage of claim 15 wherein said poly(vinyl acetal) has the following formula:

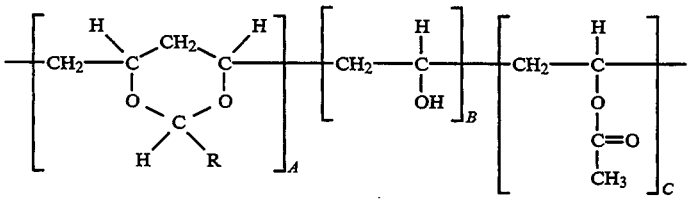

wherein R is hydrogen, $-(CH_2)_x-CH_3$,

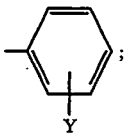

x is 0–6;

Y is hydrogen, halogen, alkyl or alkoxy of 1–6 carbon atoms, aryl of 6 to 10 carbon atoms, or a carboxylate ester;

A ranges from 30–95 mole %;

B ranges from 5–65 mole %; and

C ranges from 0–25 mole %.

17. The assemblage of claim 16 wherein R is $CH_3$ and A is at least 60 mole %.

18. The assemblage of claim 15 wherein said support is transparent.

19. The assemblage of claim 15 wherein said cushion layer is a copolymer of butyl acrylate and acrylic acid.

20. The assemblage of claim 15 wherein said polymeric dye image-receiving layer comprises a polycarbonate.

* * * * *